US007762328B2

(12) United States Patent
Tchakarov

(10) Patent No.: US 7,762,328 B2
(45) Date of Patent: Jul. 27, 2010

(54) FORMATION TESTING AND SAMPLING TOOL INCLUDING A CORING DEVICE

(75) Inventor: Borislav J. Tchakarov, Humble, TX (US)

(73) Assignee: Baker Hughes Corporation, Houston, TX (US)

( * ) Notice: Subject to any disclaimer, the term of this patent is extended or adjusted under 35 U.S.C. 154(b) by 514 days.

(21) Appl. No.: 11/540,032

(22) Filed: Sep. 29, 2006

(65) Prior Publication Data

US 2008/0078241 A1 Apr. 3, 2008

(51) Int. Cl.
*E21B 47/00* (2006.01)
*E21B 49/08* (2006.01)

(52) U.S. Cl. ..... 166/264; 166/100; 175/59

(58) Field of Classification Search ..... 166/100, 166/264; 175/59
See application file for complete search history.

(56) References Cited

U.S. PATENT DOCUMENTS 6,157,893 A * 12/2000 Berger et al. ..... 702/9
6,371,221 B1 4/2002 Harrigan et al.
6,550,549 B2 4/2003 Myrick
6,877,559 B2 * 4/2005 Hashem ..... 166/264
6,953,096 B2 10/2005 Gledhill et al.
7,191,831 B2 * 3/2007 Reid et al. ..... 166/264
7,303,011 B2 * 12/2007 Reid et al. ..... 166/264
2004/0007387 A1 1/2004 Bar-Cohen
2005/0284629 A1 12/2005 Reid et al.
2005/0284829 A1 12/2005 Shaffer
2006/0102343 A1 * 5/2006 Skinner et al. ..... 166/250.1
2008/0135240 A1 * 6/2008 Brennan et al. ..... 166/264

* cited by examiner

*Primary Examiner*—William P Neuder
(74) *Attorney, Agent, or Firm*—Mossman, Kumar & Tyler, PC

(57) ABSTRACT

A sampling tool for retrieving one or more samples from a wellbore drilled in a subterranean formation includes a coring device retrieving a core from a wellbore wall, wellbore isolation devices that isolate an annular region proximate to the coring device; and a flow device that flows fluid out of the isolated region. During operation, the sampling tool is positioned adjacent a formation of interest. The isolation device is activated to isolate an annular region proximate to the sampling tool. Decentralizing arms can be used to position the coring device next to the wellbore wall. Thereafter, the flow device flows fluid out of the isolated annular region. When the isolated region includes mostly formation fluid, the coring device is activated to retrieve a core from a wall of the wellbore in the isolated annular region and store it in formation fluid.

18 Claims, 6 Drawing Sheets

FORMATION TESTING AND SAMPLING TOOL INCLUDING A CORING DEVICE

CROSS-REFERENCE TO RELATED APPLICATIONS

None.

BACKGROUND OF THE INVENTION

1. Field of the Invention

This invention relates to the testing and sampling of underground formations or reservoirs. More particularly, this invention relates to a method and apparatus for isolating a layer in a downhole reservoir, testing the reservoir formation, analyzing, sampling, storing a formation fluid, coring a formation, and/or storing cores in a formation fluid.

2. Description of the Related Art

Hydrocarbons, such as oil and gas, often reside in porous subterranean geologic formations. Often, it can be advantageous to use a coring tool to obtain representative samples of rock taken from the wall of the wellbore intersecting a formation of interest. Rock samples obtained through side wall coring are generally referred to as "core samples." Analysis and study of core samples enables engineers and geologists to assess important formation parameters such as the reservoir storage capacity (porosity), the flow potential (permeability) of the rock that makes up the formation, the composition of the recoverable hydrocarbons or minerals that reside in the formation, and the irreducible water saturation level of the rock. These estimates are crucial to subsequent design and implementation of the well completion program that enables production of selected formations and zones that are determined to be economically attractive based on the data obtained from the core sample.

The present invention addresses the need to obtain core samples more efficiently, at less cost and at a higher quality that presently available.

SUMMARY OF THE INVENTION

In aspects, the present invention provides systems, devices, and methods to retrieve samples such as cores and fluid samples from a formation of interest. In one embodiment, a sampling tool for retrieving one or more samples from a wellbore drilled in a subterranean formation includes a coring device that retrieves a core from a wall of the wellbore with a coring bit. The annular zone or region proximate to the coring bit is isolated with a wellbore isolation device such as expandable packers. In embodiments, one or more decentralizing arms can be used to position the coring device next to the wellbore wall.

Coring can be performed in an at-balance or under-balanced condition by pumping fluid out of the isolated zone using a flow device such as a drawdown pump. Initially, the fluid in the isolated zone is mostly wellbore fluid or fluid having undesirable contaminations. As this wellbore fluid is pumped out, the isolated zone fills with pristine formation fluid. In one arrangement, the coring, core retrieval, and storage of the retrieved core sample are done only with substantially pristine formation fluid. The apparatus can also include one or more sensors that analyze the fluid retrieved from the isolated region.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
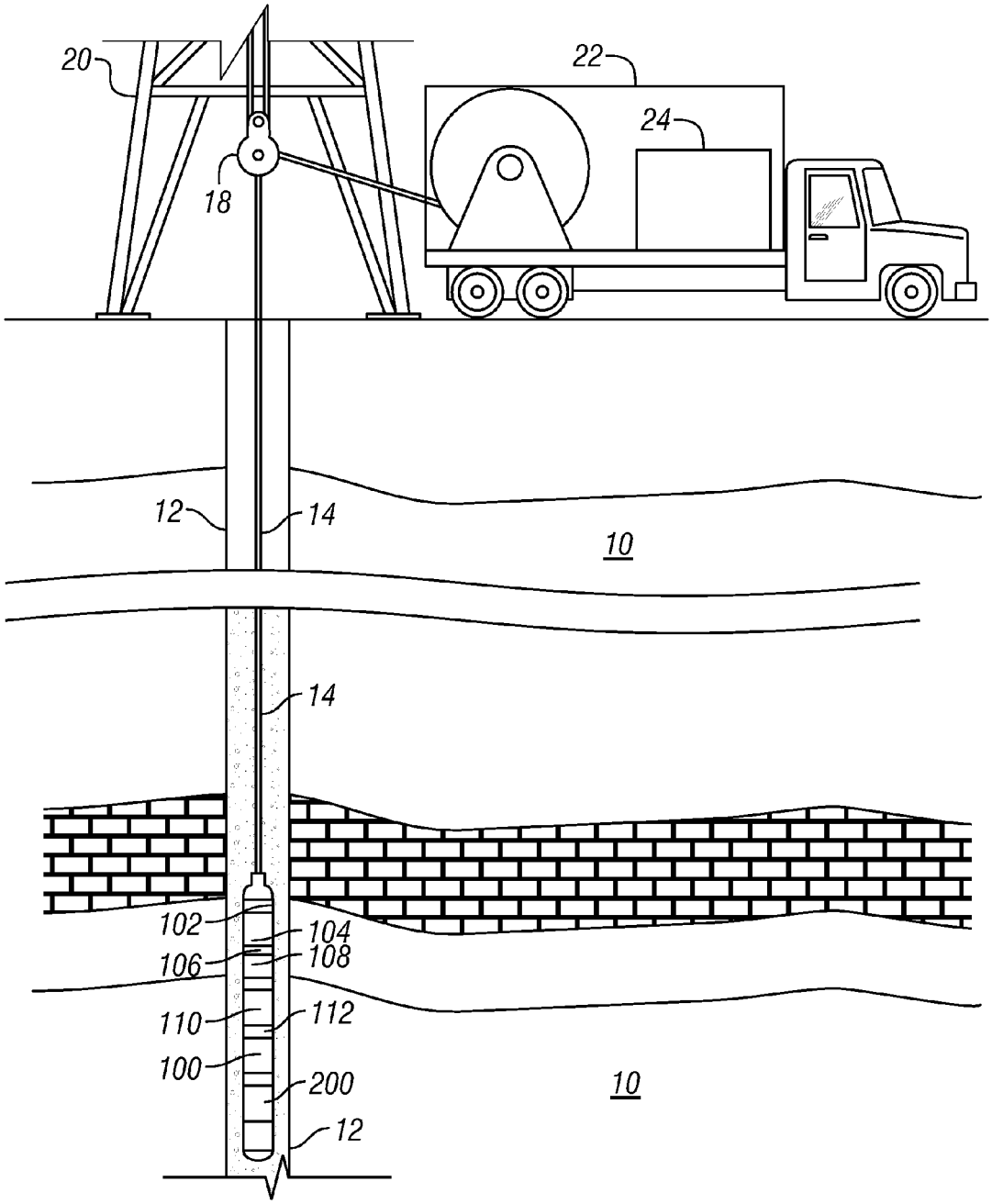
FIG. 1 schematically illustrates a sectional elevation view of a sectional elevation view of a system utilizing a formation sampling device made in accordance with one embodiment of the present invention.

The present invention relates to devices and methods for obtaining formation samples, such as core samples and fluid samples, from subterranean formations. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. Indeed, as will become apparent, the teachings of the present invention can be utilized for a variety of well tools and in all phases of well construction and production. Accordingly, the embodiments discussed below are merely illustrative of the applications of the present invention.

Referring initially to FIG. 1, there is schematically represented a cross-section of subterranean formation 10 in which is drilled a wellbore 12. Usually, the wellbore will be at least partially filled with a mixture of liquids including water, drilling fluid, and formation fluids that are indigenous to the earth formations penetrated by the wellbore. Hereinafter, such fluid mixtures are referred to as "wellbore fluids". The term "formation fluid" hereinafter refers to a specific formation fluid exclusive of any substantial mixture or contamination by fluids not naturally present in the specific formation. Suspended within the wellbore 12 at the bottom end of a wireline 14 is a formation sampling tool 100. The wireline 14 is often carried over a pulley 18 supported by a derrick 20. Wireline deployment and retrieval is performed by a powered winch carried by a service truck 22, for example. A control panel 24 interconnected to the tool 100 through the wireline 14 by conventional means controls transmission of electrical power, data/command signals, and also provides control over operation of the components in the formation sampling tool 100. As will be discussed in greater detail below, the tool 100 is fitted with equipment and tool that can enable the sampling of formation rock, earth, and fluids under a variety of conditions.

Figure 2:
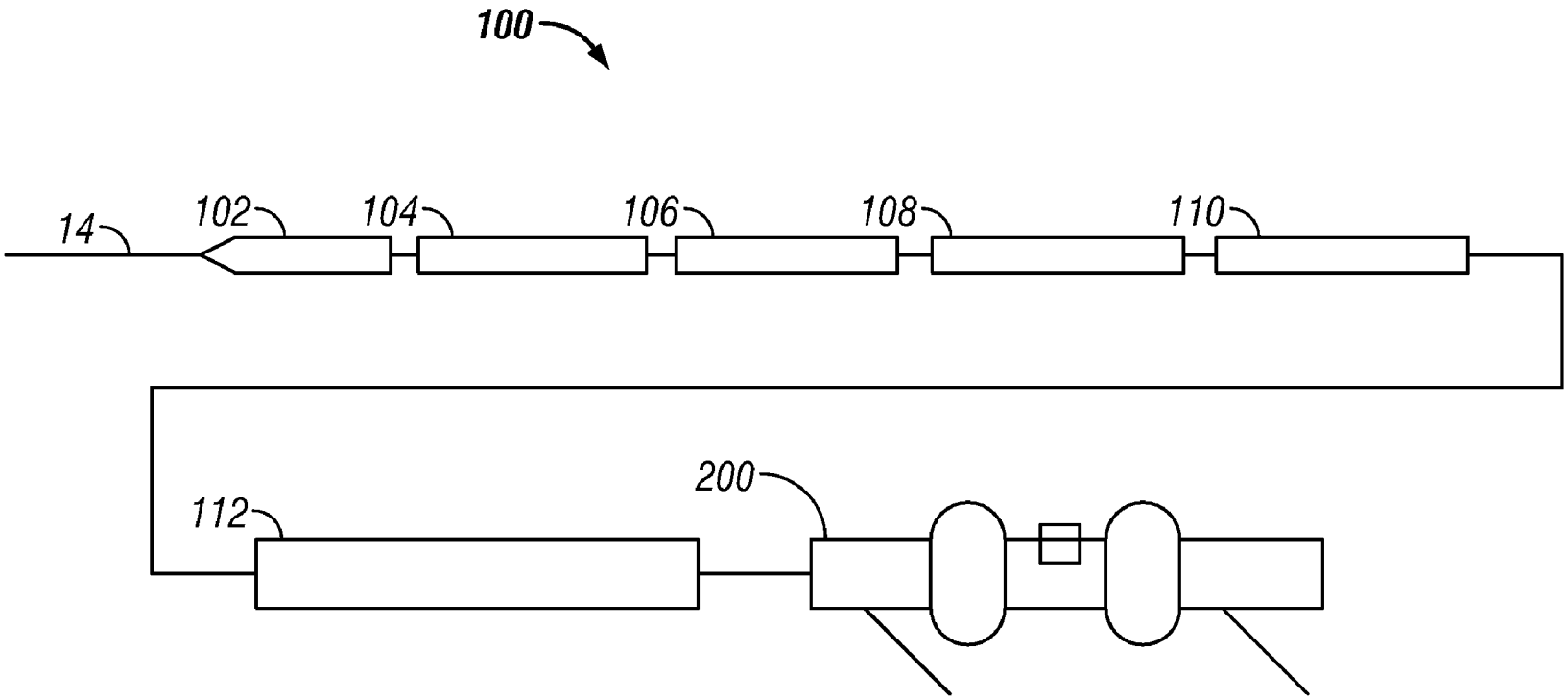
FIG. 2 schematically illustrates a formation sampling tool made in accordance with one embodiment of the present invention.

Referring now to FIG. 2, there is schematically illustrated one embodiment of a formation sampling tool 100 that can retrieve one or more samples, such as fluid and/or core samples, from a formation. The tool 100 includes a cable head 102 that connects to the wireline 14, a plurality of modules 104 and 106, an electronics module 108, a hydraulics module 110, a formation testing module 112 and a coring module 200. The formation testing module 112 is configured to retrieve and store fluid samples and the coring module 200 is configured to retrieve and store core samples, which also may contain fluid. The modules 112 and 200 can also include analysis tools that perform downhole testing on the retrieved samples. The hydraulics module 110 provides hydraulic fluid for energizing and operating the modules 112 and 200 and can include pumps, accumulators, and related equipment for furnishing pressurized hydraulic fluid. The electronics module 108 includes suitable circuitry, controllers, processors, memory devices, batteries, etc. to provide downhole control over the sampling operations. The electronics module 108 can also include a bi-directional communication system for transmitting data and command signals to and from the surface. Exemplary equipment in the electronics module 108 can include controllers pre-programmed with instructions, bi-directional data communication equipment such as transceivers, A/D converters and equipment for controlling the transmission of electrical power. It should be appreciated that the modular nature of the tool 100 can simplify its construction, e.g., two or more sampling modules, such as modules 112 and 200, can share the same electronics and hydraulics. Moreover, the tool 100 can be configured as needed to accomplish specific desired operations. For instance, the modules 104 and 106 can be utilized to house additional tools, such as survey tools, formation evaluation tools, reservoir characterization tools, or can be omitted if not needed. Therefore, it should be understood that the formation testing module 112 and the coring module 200 are merely some of the tools and instruments that could be deployed with the tool 100.

Figure 3:
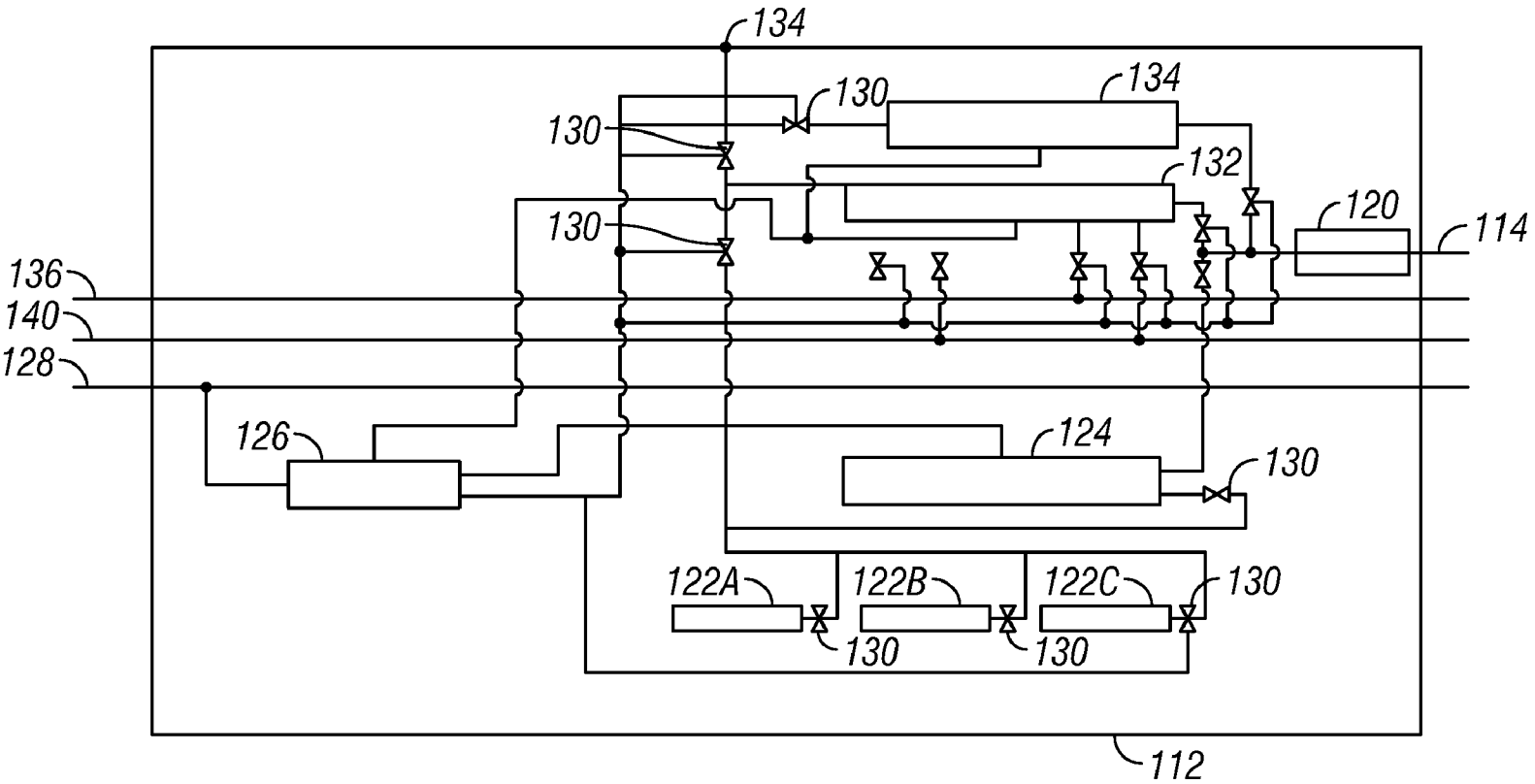
FIG. 3 schematically illustrates a fluid sampling device made in accordance with one embodiment of the present invention.
Figure 4:
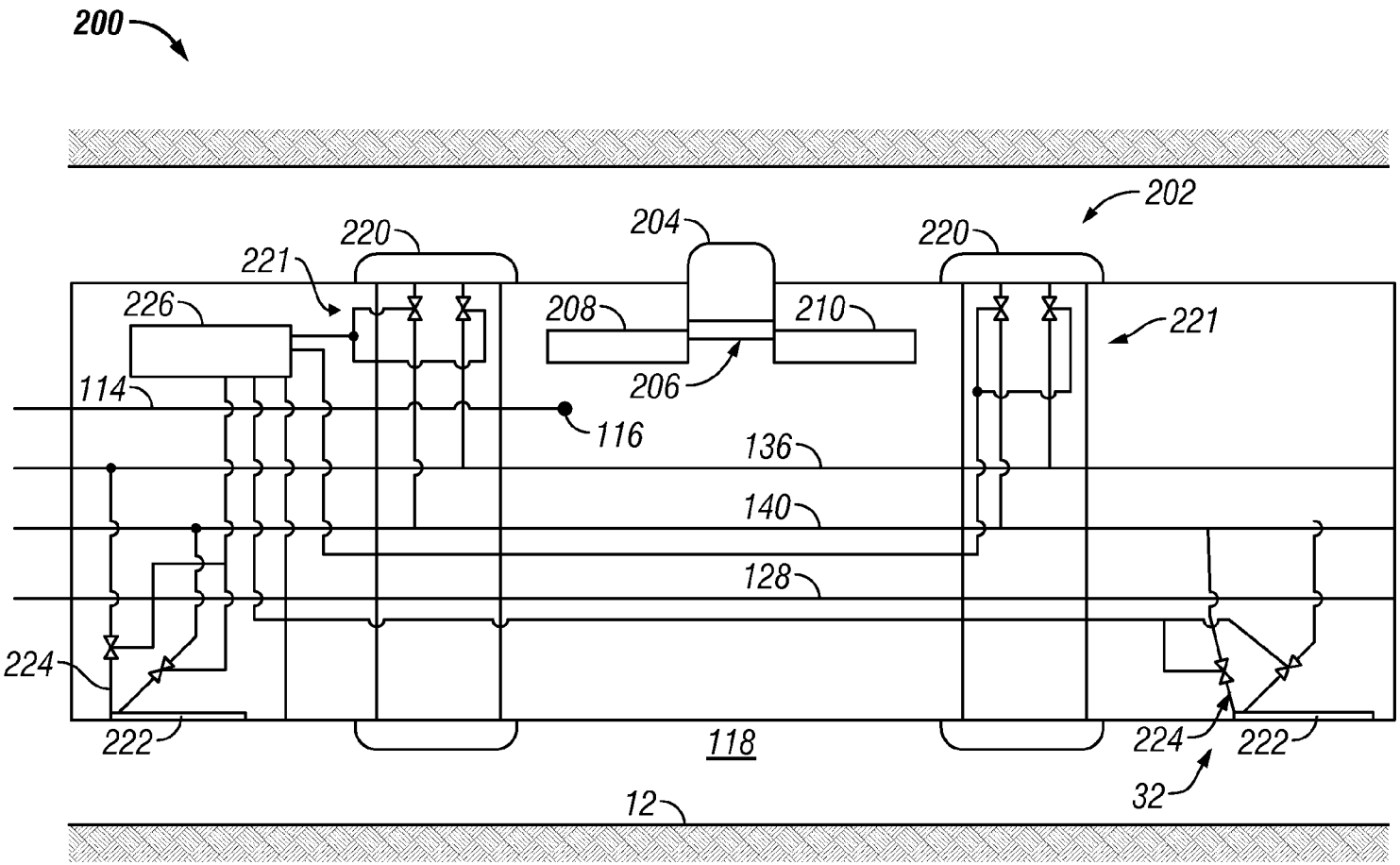
FIG. 4 schematically illustrates a coring device made in accordance with one embodiment of the present invention.

Referring now to FIGS. 3 and 4, the formation testing module 112 is configured to measure a formation pressure precisely, and to receive, analyze and/or store fluids retrieved from a formation. The module 112 retrieves fluid using a flow device such as a drawdown pump 134 that is connected to one or more sampling lines 114 that terminate at the coring module 200. For example, an illustrative sample line 114 can terminate at an opening 116 on the coring module 200. The opening 116 retrieves fluid in an annular space 118 surrounding the coring module 200. In one embodiment, the opening 116 is positioned at or near the top of the annular space 118 and has a filter (not shown) to prevent cuttings or debris from going into the formation testing module 112. Also, the drawdown pump 134 can provide bi-directional flow, which allows the filter (not shown) to be flushed out and cleaned prior to reuse. The retrieved fluid is analyzed by one or more formation characterization sensors 120, e.g., Sample View and RC sensors available from Baker Hughes Incorporated, and eventually stored in a bank of sample carriers 122*a-c*. Prior to or during storage, suitable sensors such as pressure gauges 124 are used to monitor selected fluid parameters, to evaluate sample characteristics, and to determine sample quality for the retrieved fluid. Control over the fluid retrieval process is provided by a module control manifold 126 that is connected to a power/communication bus 128 leading to the electronics module 108 (FIG. 2). In one arrangement, the control manifold 126 is operatively connected to flow control devices such as valves, some representative valves being labeled with numeral 130. The control manifold 126 can also control pump devices such as a pump thru module 132 and a drawdown module 134. One exemplary formation and reservoir characterization instrument is RCI$^{SM}$ available from Baker Hughes Incorporated. Exemplary formation analysis modules also include SampleView$^{SM}$, which provides real-time, near-infrared spectra of a formation fluid pumped from the formation and can be used to assess fluid type and quality downhole, an R/C sensor that comprises resistivity and fluid capacitance positioned on the flowline to determine the fluid type.

Referring now to FIG. 4, there is schematically shown one embodiment of a coring module 200 that retrieves core samples from the formation. The coring module 200 uses a coring device 202 for extracting a core sample from a formation. In one embodiment, the coring device 202 includes coring bit 204 and a bit drive 208 consisting of motor and transmission for rotationally turning the coring bit. A bit box 206 deploys and retracts the coring bit 204 into the formation and applies the necessary force on the bit to perform the coring function, and a core container 210 for receiving the coring sample. In one embodiment, the coring bit 204 is mounted on the end of a cylindrical mandrel (not shown) mounted within the bit box 206. The bit box 206 provides lateral movement with respect to the longitudinal axis of the module 200. The mandrel (not shown) is hollow for accepting the drilled core sample and retaining the core sample during the retracting operation of the coring bit 204. A drive motor (not shown) for rotating the coring bit 204 is preferably a high torque, high speed DC motor or a low speed high torque hydraulic motor and can include suitable gearing arrangements for gearing up or down the drive speed imparted to a drive gear (not shown). The coring device 202 can utilize a self-contained power system, e.g., a hydraulically actuated motor, and/or utilize the hydraulic fluid supplied by the hydraulics module 106. Additionally, the electronics module 108 and/or the surface control panel 24 can provide electrical power and/or control for the coring module 200.

The module 200 includes isolation elements or members that can isolate an annular zone or section 118 proximate to the coring device 202. It should be appreciated that isolating a zone along the wellbore axis, rather than a localized point on a wellbore wall, increases the likelihood that formation fluid can be efficiently extracted from a formation. For instance, a wellbore wall could include laminated areas that block fluid flow or fractures that prevent an effective seal from being formed by a pad pressed on the wellbore wall. An isolated axial zone provides a greater likelihood that a region or area having favorable flow characteristics will be captured. Thus, laminated areas or fractures will be less likely to interfere with fluid sampling. Moreover, the formation could have low permeability, which restricts the flow of fluid out of the formation. Utilizing a zone can increase the flow rate of fluid into the zone and therefore reduce the time needed to obtain a pristine fluid sample.

In one embodiment, the isolation members include two or more packer elements 220 that selectively expand to isolate the annular section 118. When actuated, each packer element 220 expands and sealingly engages an adjacent wellbore wall 11 to form a fluid barrier across an annulus portion of the wellbore 12. In one embodiment, the packer elements 220 use flexible bladders that can deform sufficiently to maintain a sealing engagement with the wellbore wall 11 even though the module 200 is not centrally positioned in the wellbore 12. The fluid barrier reduces or prevents fluid movement into or out of the section 118. As will be seen below, the module 200 can cause the section 118 of the wellbore between the packer elements 220 to have a condition different from that of the regions above and below the section 118; e.g., a different pressure or contain different fluids. In one embodiment, the packer elements 220 are actuated using pressurized hydraulic fluid received via the supply line 136 from the hydraulics module 106. In other embodiments, the packer elements 220 can be mechanically compressed or actuated using moving parts, e.g., hydraulically actuated pistons. Valve elements 221 control the flow of fluid into and out of the packer elements 220. The module 200 can include a control manifold 226 that controls the operation of the packer elements 220, e.g., by controlling the operation of the valve elements 221 associated with the packer elements 220. The fluid return line 140 returns hydraulic fluid to the hydraulics module 106. While two "stacked" packers are shown, it should be understood that the present invention is not limited to any number of isolation elements. In some embodiments, a unitary isolation element could be used to form an isolated annular zone or region.

To radially displace the coring module 200, the module 200 includes upper and lower decentralizing arms 222 located on the side of the tool generally opposite to the coring bit 204. Each arm 222 is operated by an associated hydraulic system 224. The arms 222 can be mounted within the body of module 200 by pivot pins (not shown) and adapted for limited arcuate movement by hydraulic cylinders (not shown). In one embodiment, the arms 222 are actuated using pressurized hydraulic fluid received via the supply line 136 from the hydraulics module 106. The control manifold 226 controls the movement and positioning of the arms 222 by controlling the operation the hydraulic system 224, which can include valves. The fluid return line 140 returns hydraulic fluid to the hydraulics module 106. Further details regarding such devices are disclosed in U.S. Pat. Nos. 5,411,106 and 6,157,893, which are hereby incorporated by reference for all purposes.

Figure 5:
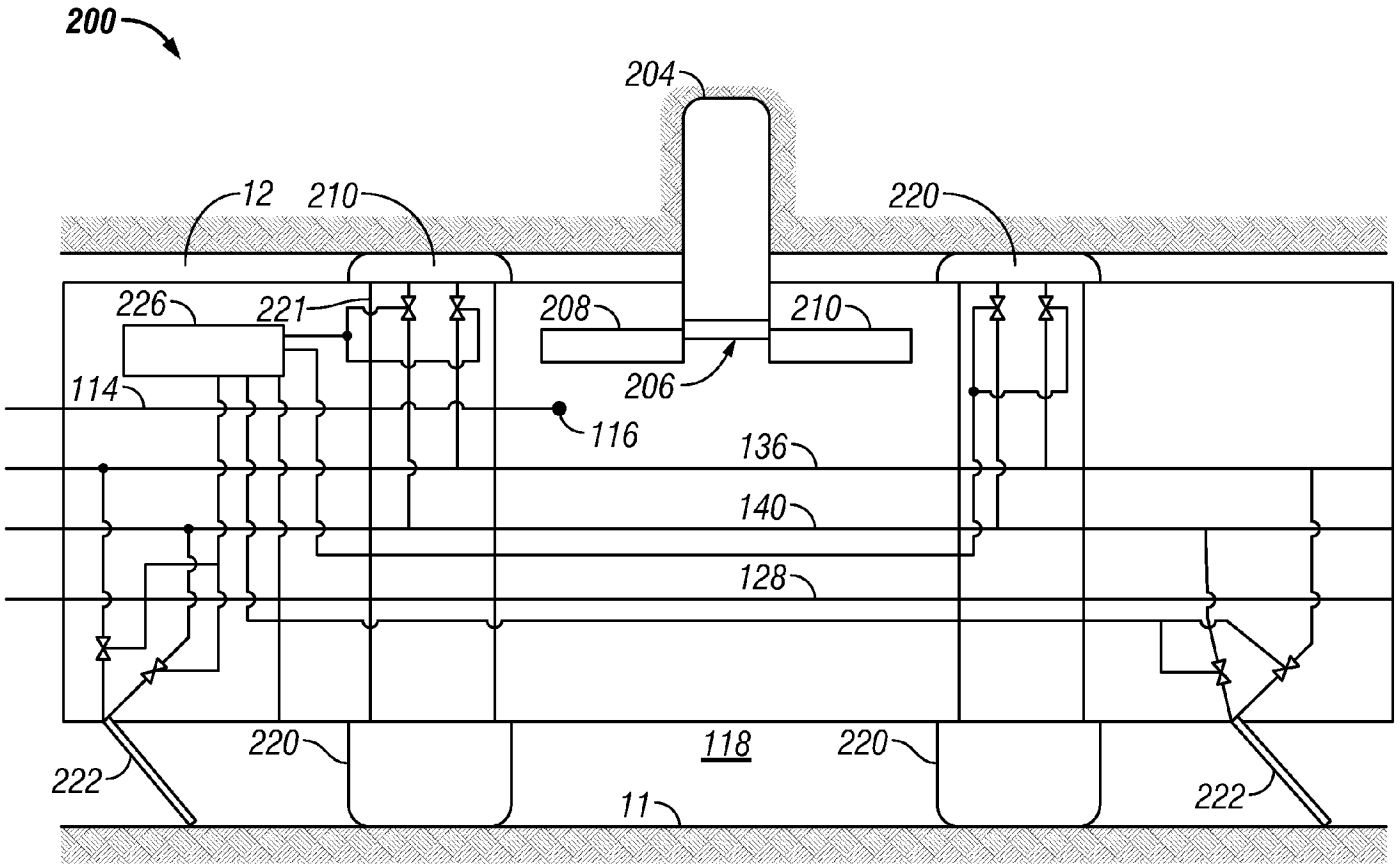
FIG. 5 schematically illustrates a coring device made in accordance with one embodiment of the present invention in a coring position.

Referring now to FIG. 5, the module 200 is shown lowered in the wellbore 12 by a conveyance device 14 to a desired depth for obtaining a core from formation 10. In FIG. 5, the coring bit 204 is shown fully deployed through the body of the module 200 to retrieve a core from the formation 10. The module 200 is locked in place against the wellbore wall 11 by arms 222. In this position, the support arms 222 radially displace the module 200 and thereby position the coring bit 204 closer to the wellbore wall 11. Additionally, the packer elements 220 are expanded into sealing engagement with the wellbore wall 11. Thus, the region 118 has been hydraulically isolated from the adjacent regions of the wellbore 12. At this point, the pressure in the region 118 can be reduced by activating the pump thru pump 132. The pump thru pump 132 pumps fluid out of the region 118, which allows formation fluid to fill the region 118. The formation fluid sampling module 112 can continuously monitor the fluid being pumped out of the region 118 using the sensors module 120. After the sensor package/module 120 shows clean formation fluid is pumped the module 200 can store one or more clean samples in the tanks 122, perform a precise drawdown using drawdown pump 134 and initiate coring. In one arrangement, the fluid is analyzed for contaminants such as drilling fluid. In many instances, it is desirable to begin coring only after the region 118 has only formation fluid. Upon being secured in this position and verifying that the region 118 is relatively clean of contaminants, the coring device 202 is energized. In one arrangement, the bit box 206 thrusts the coring bit 204 radially outward into contact with the wellbore wall 11 while a hydraulic or electric motor 208 rotates the coring bit 204. The coring bit 204 advances into the formation a predetermined distance. Because the coring bit 204 is hollow, a core sample is formed and retained within the cylindrical mandrel (not shown) during this drilling action. After the coring bit 204 reaches the limit the core is broken by tilting the bit box 206 and retracted into the body of the module. The core is stored into the core container 210 in formation fluid.

Retrieving core samples within a hydraulically isolated zone provides at least three advantages. First, because the pressure in the region 118 is reduced and the region 118 is hydraulically isolated from the remainder of the wellbore 12, coring can be done with the wellbore in an at-balance or an under-balanced condition, i.e., the fluid in the formation being approximately the same as or at a greater pressure than the fluid in the region 118. Coring in an underbalanced condition can be faster than the traditional overbalanced condition present during conventional coring operations. Second, because the region 118 is full with relatively clean formation fluid, the formation fluid sampling module 112 via line 114 and opening 116 can retrieve this clean formation fluid either before, during or after the core sample or samples have been taken. As noted above, these fluid samples can be analyzed and stored. The formation fluid sampling module 112 can also perform other tests such as a pressure profile or drawdown test. Moreover, the core samples can also be stored with this relatively clean formation fluid. Third, because coring is done with pristine formation fluid in the region 118, the risk that the coring sample is contaminated by wellbore fluids is reduced, if not eliminated. Thus, the at-balance or under-balanced condition can provide for cleaner and faster coring operations and yield higher quality samples. It should be therefore appreciated that embodiments of the present invention can provide a core that has been cut, retrieved and stored in pristine formation fluid.

Figure 6:
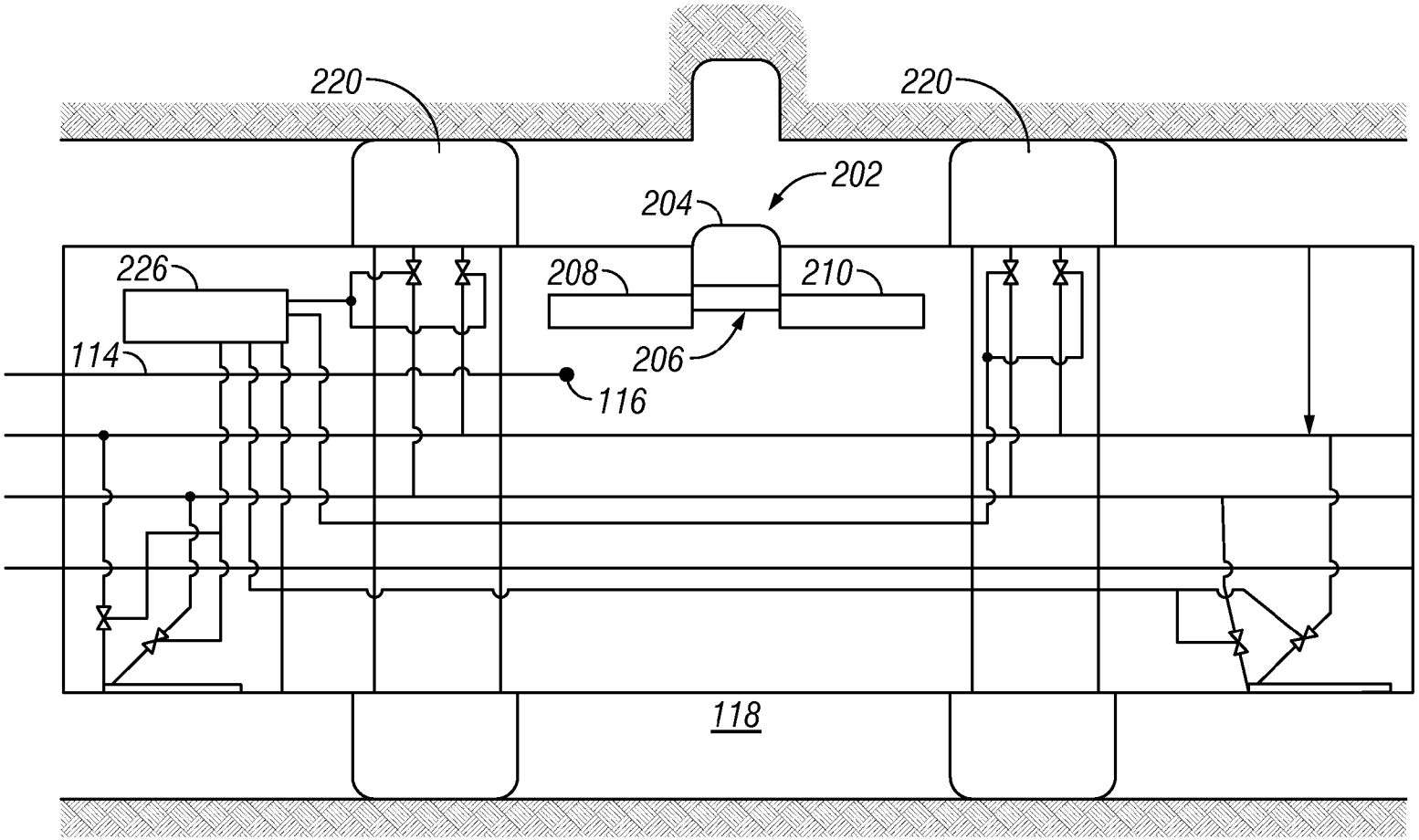
FIG. 6 schematically illustrates a coring device made in accordance with one embodiment of the present invention after retrieving a core sample.

Referring, now to FIG. 6, after the core is obtained, the coring bit 204 is retracted into the body of module 200 and the core is stored into the core container 210 in formation fluid and the decentralizing arms 222 are also retracted into the body of module 200. The module 200 may then be raised and removed from the wellbore 12 by the wireline 14 and the core retrieved from the module 200 for analysis. Additionally, one coring device 202 can be utilized to obtain multiple coring samples, each of which are saved in a separate chamber.

It should be understood that the teachings of the present invention can also be utilized with conveyance devices other than wireline, such as slick line, coiled tubing and drill pipe.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A method for taking a sample from a subterranean formation, comprising:

conveying a tool into a wellbore intersecting the subterranean formation;

substantially isolating an annular region proximate to the tool;

flowing fluid out of the annular region;

retrieving at least one core sample from the subterranean formation in the annular region after the annular region is substantially filled with a formation fluid;

operatively coupling an electronics module to the coring device to provide at least one of: (i) power, (ii) communication signals.

2. The method of claim 1 further comprising decreasing a pressure in the annular region until the annular region is at one of: (i) an at-balanced condition, and (ii) an underbalanced condition.

3. The method of claim 1 further comprising retrieving a fluid sample from the annular region.

4. The method of claim 3 further comprising analyzing the retrieved fluid sample.

5. The method of claim 3 further comprising storing the fluid sample with the at least one core sample in a same container.

6. The method of claim 3 further comprising storing the fluid sample at a separate location.

7. The method of claim 1 further comprising performing in the annular region one of (i) a pressure profile test, and (ii) a drawdown test.

8. An apparatus for retrieving a sample from a wellbore drilled in a subterranean formation, comprising:

a coring device;

an isolation member substantially isolating an annular region proximate to the coring device;

a pump in fluid communication with the wellbore and with the annular region; and an electronics module operatively coupled to the coring device to provide at least one of: (i) power, (ii) communication signals.

9. The apparatus of claim 8 wherein the pump decreases a pressure in the annular region to at least an at balanced condition.

10. The apparatus of claim 8 wherein the pump pumps fluid out of the annular region until the annular region is substantially filled with a formation fluid.

11. The apparatus of claim 8 further comprising at least one sensor analyzing a fluid retrieved from the annular region.

12. The apparatus of claim 8 further comprising a fluid sampling device retrieving a fluid sample from the annular region.

13. The apparatus of claim 8 further comprising a container receiving at least one core sample retrieved by the coring device.

14. The apparatus of claim 8 wherein the isolation member comprises at least two axially spaced-apart isolation elements.

15. The apparatus of claim 8 further comprising a hydraulics module energizing one of: (i) the coring device, (ii) the annular isolation member, and (iii) the pump.

16. The apparatus of claim 8 further comprising at least one arm radially displacing the coring device.

17. The apparatus of claim 8 further comprising a wireline coupled to the coring device.

18. An apparatus for retrieving a sample from a wellbore drilled in a subterranean formation, comprising:

a coring device;

an isolation member substantially isolating an annular region proximate to the coring device;

a pump in fluid communication with the wellbore and with the annular region;

a container configured to receive at least one core sample retrieved by the coring device and store the at least one core sample in a formation fluid; and an electronics module operatively coupled to the coring device to provide at least one of: (i) power, (ii) communication signals.

* * * * *